United States Patent [19]

Mol

[11] Patent Number: 4,787,311

[45] Date of Patent: Nov. 29, 1988

[54] MAILING MACHINE ENVELOPE TRANSPORT SYSTEM

[75] Inventor: Hans C. Mol, Wilton, Conn.

[73] Assignee: Pitney Bowes Inc., Stamford, Conn.

[21] Appl. No.: 87,268

[22] Filed: Aug. 19, 1987

[51] Int. Cl.[4] ..... B41F 5/04

[52] U.S. Cl. ..... 101/232; 271/4; 271/10; 271/111; 271/182; 271/258; 271/270; 198/461; 198/575

[58] Field of Search ..... 101/216, 232, 233; 198/461, 575, 577; 271/4, 10, 111, 182, 258, 259, 270, 314; 318/696, 301, 305, 336

[56] References Cited

U.S. PATENT DOCUMENTS

| | | | |
|---|---|---|---|
| 3,581,000 | 5/1971 | Hansen | 271/270 |
| 3,789,286 | 1/1974 | Towne et al. | 318/696 |
| 3,827,545 | 8/1974 | Buhayar | 271/203 |
| 3,832,944 | 9/1974 | Woerner et al. | 101/232 |
| 3,855,041 | 12/1974 | Kunisch | 101/232 |
| 3,894,734 | 7/1975 | Sette et al. | 271/2 |
| 3,915,089 | 10/1975 | Scubert | 101/232 |
| 3,960,079 | 6/1976 | Capetti | 101/232 |
| 4,015,701 | 4/1977 | Templeton | 271/270 |
| 4,073,223 | 2/1978 | Crawford | 271/182 |
| 4,113,244 | 9/1978 | Ruenzi | 271/270 |
| 4,128,327 | 12/1978 | Sugiyama et al. | 271/270 |
| 4,140,310 | 2/1979 | Schroter | 271/270 |
| 4,211,397 | 7/1980 | Hansen et al. | 271/270 |
| 4,272,069 | 6/1981 | Matthews | 271/182 |
| 4,318,540 | 3/1982 | Paananen et al. | 271/270 |
| 4,331,328 | 5/1982 | Fasig | 271/270 |
| 4,362,100 | 12/1982 | Wu et al. | 101/233 |
| 4,451,027 | 5/1984 | Alper | 271/270 |
| 4,470,349 | 9/1984 | Godlewski | 101/233 |
| 4,516,759 | 5/1985 | Kobler | 101/232 |
| 4,524,691 | 6/1985 | Miller | 101/232 |
| 4,569,514 | 2/1986 | Holtje | 271/270 |
| 4,573,673 | 3/1986 | Haug | 271/270 |
| 4,688,481 | 8/1987 | Cargill | 101/233 |

FOREIGN PATENT DOCUMENTS 0057810 4/1985 European Pat. Off. .

*Primary Examiner*—Eugene H. Eickholt

*Attorney, Agent, or Firm*—Charles G. Parks, Jr.; David E. Pitchenik; Melvin J. Scolnick

[57] ABSTRACT

A postage meter is mounted to a mailing machine at a location along the feed deck of the mailing machine such that a portion of the postage meter is in spaced relation to the feed deck to define a printing station. An inserter or other type of mailpiece inserter delivers a plurality of mailpieces to the feed deck of the mailing machine in a seriatim manner for the printing of an indicia on each of the mailpieces as it traverses the print station by the postage meter. The mailing machine is provided with a transport system comprising means for capturing each of the mailpieces as it is received from the inserter and controllably transporting the mailpiece along the feed deck and maintaining control during indicia printing by the postage meter and thereafter ejecting the mailpiece from the mailing machine. Also, a control means is provided for controlling the transport speed such that the initial velocity of the transport is generally equal to or greater than the velocity of the fed mailpiece. Subsequent to establishing control of the mailpiece and prior to indicia printing, the control means adjust the speed of the transport to a predetermined velocity if the initial velocity of the mailpiece is not equal to the predetermined velocity.

13 Claims, 6 Drawing Sheets

MAILING MACHINE ENVELOPE TRANSPORT SYSTEM

BACKGROUND OF THE INVENTION

This invention relates to mailpiece transport means and, more particular, to mean of transporting a mailpiece along a postage meter mailing machine feed deck for the printing of a postage indicia on the mailpiece.

It is a known practice to associate an inserter with a postage meter mailing machine. The inserter's function is to collate and insert a set of fill materials into a respective envelope of an envelope stream and moisten the envelope for sealing. The inserter then delivers the envelopes seriately to the feed deck of a mailing machine. A postage meter is mounted to the mailing machine and operated in concert therewith for the printing of a postage indicia on each of the traversing envelopes fed to the mailing machine by the inserter.

The conventional postage meter includes a print drum which is intended to experience a single revolution per print cycle. The print drum is generally driven by a prime mover located within the mailing machine and mechanically coupled to the postage meter print drum. The prime mover is actuated to commence a print cycle upon the encounter of a trigger mounted to the mailing machine feed deck by a traversing envelope thereby causing a control system to actuate the prime mover. Under the influence of the control system the prime mover drives the print drum such that a given peripheral velocity for indicia printing is obtained to which the linear velocity of the traversing enevelope is matched by a transport system. It is necessary to match the linear velocity of the traversing envelope with the peripheral velocity of the print drum in order for the print drum to print a quality indicia, i.e., an indicia which is not smeared or otherwise degraded. Hence, it is the function of the transport system not only to transport an envelope to the postage meter for indicia printing but also to alter the envelope speed to be matching to the given peripheral speed of the print drum. It is noted that the conventional postage meter mailing machine requires the postage meter print drum to be operated at a given speed which represents the maximum print speed. It would therefore be beneficial from a wear and noise standpoint, under appropriate circumstances, e.g., should the inserter deliver envelopes at a slow speed, if the peripheral speed of the print drum could be reduced to be matching to the slower delivery of the inserter. In order to facilitate the operation of the postage meter at a slower speed, it would be advantageous for the transport system to be able to recognize the slower envelope speed and adjust the transport speed and cause the control system to adjust the drive characteristic of the postage meter print drum prime mover accordingly.

Under certain conditions, it is preferable or desirable to further establish a base or minimum operation speed at which envelopes are delivered for indicia printing. Therefore, under such conditions, it would be of further benefit that the transport system have the capability to recognize when an envelope is received from the inserter at a relative speed below the base operation speed and increase the speed of the received envelope to the base speed. It is noted that the afore considerations has been recited as relating to postage meter indicia printing by a print drum, however, the consideration is equally applicable to other forms of printing, for example, ink jet, thermal, etc.

SUMMARY OF THE INVENTION

It is an objective of the present invention to present a transport system particularly suited for employment in a mailing machine whereby the transport system receives a item such as a envelope at a given speed and speed adjust the item prior to delivery of the item to a workstation such as postage meter for indicia printing.

The mailing machine includes a feed deck which is aligned at one end to receive envelopes separately from an inserter or other envelope delivery means. A postage meter is mounted to the mailing machine feed deck at a point there-along such that a portion of the postage meter overhangs a portion of the feed deck to define a printing station. The portion of the postage meter overhanging the feed deck has supported therein a print drum or other suitable indicia printing means.

The mailing machine transport assembly includes a first set of lower rollers mounted ahead or upstream of the printing station on a transverse shaft within the mailing machine such that a portion of the first lower rollers extends through respectively aligned slots in the feed deck. A second set of lower rollers are, in like manner, mounted to a second shaft within the mailing machine and have a portion extending through respectively aligned slots in the deck. The first and second lower rollers are longitudinally aligned in transversely staggered orientation. Each shaft includes a sprocket at a corresponding end. A mailing machine support structure overhangs the deck for rotatably supporting a plurality of upper rollers biased into tangential peripheral contact with a respective one of the lower rollers. The upper rollers are bias mounted in such a manner that the upper rollers can be vertically displaced in response to the thickness of a traversing envelope. Ejection rollers are drivingly mounted on a shaft rearward or downstream of the print station in the mailing machine such that a portion to the rollers extend through respective aligned slots in the feed deck and are in cooperative alignment with upper ejection rollers rotatably mounted to the postage meter in a conventional manner. The ejection shaft also includes a gear mounted therealong.

A single stepper motor, under the control of a microcomputer, is mounted within the mailing machine. The output shaft of the stepper motor has mounted therearound a sprocket which sprocket is in driving communication with the sprockets associated with each of the aforementioned shafts. In response to the input of two sensors mounted to the feed deck in fixed longitudinal distance ahead of the transport sensing system, the sensors being sequentially actuated by the introduction of a traversing envelope, the microcomputer calculates the incoming velocity of the approaching envelope. Upon receiving the envelope between the upper and lower rollers of the transport system and actuation of a third sensor by the traversing envelope, the microcomputer decelerates the stepper motor to impart to the envelope a linear velocity matching to the print velocity specified for the postage meter. The microcomputer then accelerates the stepper motor to a angular velocity predicted upon the arrival velocity of the envelope. Optionally, should the envelope have a linear velocity less than the specified printing speed, the microcomputer can cause the transport system to assume a match velocity to the envelope's incoming velocity and incrementally decreases the print cycle speed of the postage meter.

Other benefits and objectives of the present invention will be apparent to one skilled in the art from the following detailed description of the invention's preferred embodiment.

DETAILED DESCRIPTION OF THE PREFERRED EMBODIMENT

Figure 1:
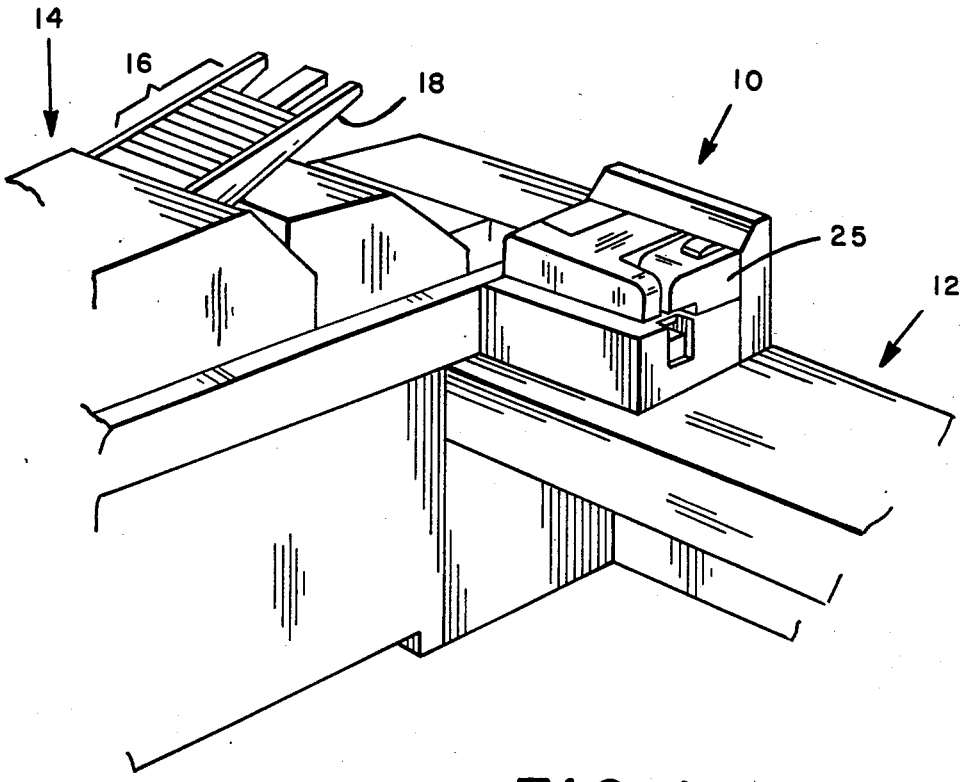
FIG. 1 is a perspective view of a postage meter mailing machine in cooperative operation with a inserter.
Figure 2:
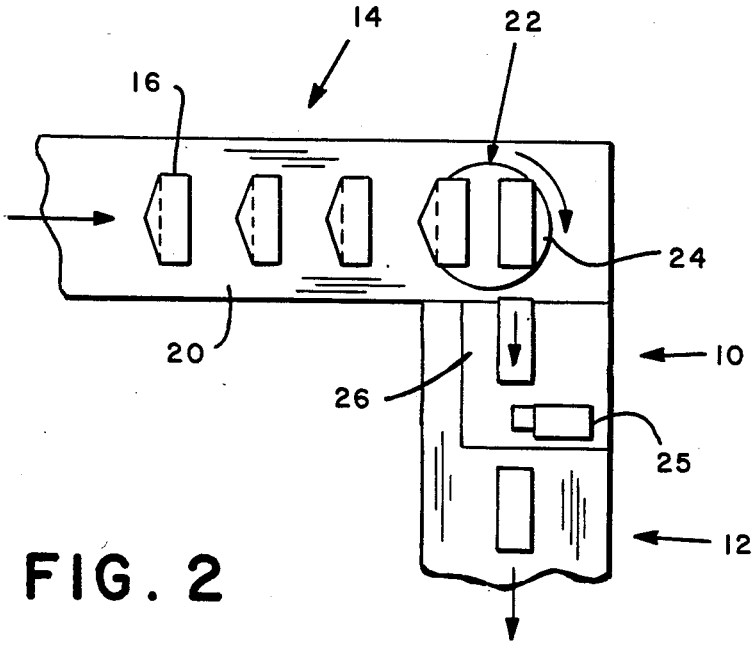
FIG. 2 is a schematic representation of the envelope travel path through the envelope inserter and mailing machine.

Referring now to the drawings and, more particularly, to FIGS. 1 and 2 thereof, there is shown a mailing machine, generally designated by the reference numeral 10, mounted atop a support table 12 by any suitable means. The mailing machine 10 is positioned at a right angle to a generally conventional inserter 14. Conventionally, a stack of envelopes 16 are deposited in the receiving trays 18 of the inserter 14. The inserter 14 performs in a conventional manner to deposit in each envelope a particular set of fill materials. The envelopes are then delivered to the mailing machine 10 in a seriatim manner from the inserter deck 20. The inserter deck 20 includes a moistening station 22 which includes a conventional envelope flap folding means (not shown) as part of a rotation plate 24. The plate 24 rotates the envelope into proper alignment to the mailing machine 10 such that the envelope can be ejected therefrom onto the mailing machine feed deck 26 by an appropriate and conventional mechanism (not shown) constituent to the inserter. The mailing machine 10 receives the envelope and transports the envelope to a postage meter 25 for the printing of an indicia thereon.

Figure 3:
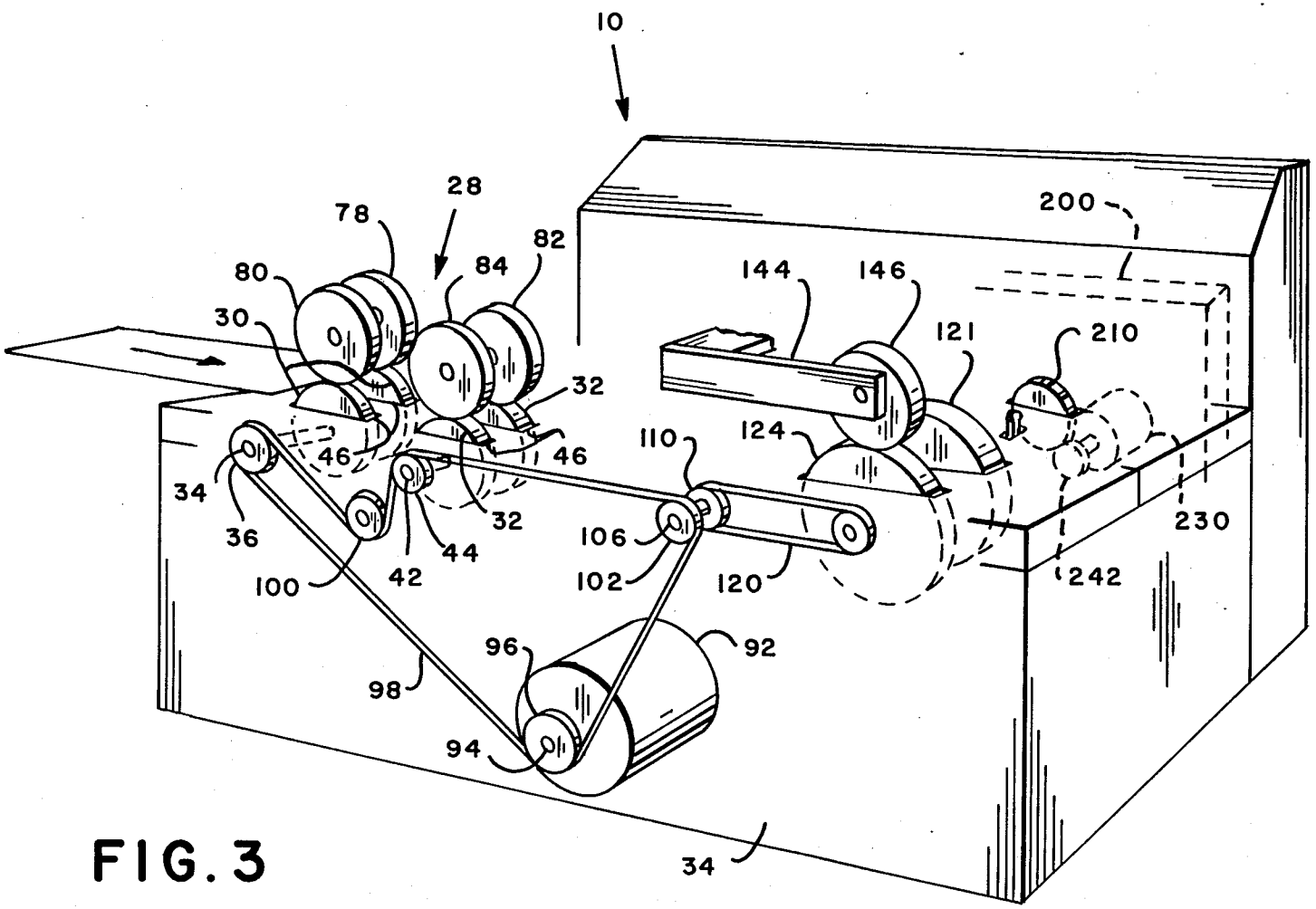
FIG. 3 is a schematic representation of the mailing machine showing in part a transport assembly in accordance with the present invention.

Referring more particularly to FIG. 3, an envelope 16 is received on the mailing machine deck 26. The deck 26 is abutting at the left-hand end (as viewed in the figures) to the ejection end of the inserter 14 for receive envelopes therefrom. The mailing machine 10 includes a transport assembly 28, more fully described subsequently, suitably accommodated by the mailing machine feed deck 26. The envelope 16 is placed under the positive control of the transport assembly 28 subsequent to its introduction to the feed deck 26 which control is maintained throughout the envelopes' journey across the mailing machine 10.

Referring to FIG.'s 3, 4 and 5, generally the transport assembly 28 includes a plurality of lower rollers 30 and 32. For drivingly supporting the lower rollers 30, a shaft 34 is rotatably mounted by any conventional means between forward support wall 36 and rear support wall 38 of the mailing machine just below the feed deck 26. The shaft 34 drivingly supports the rollers 30 in fixed axially spaced apart relationship. Drivingly mounted to the foward end of the shaft 34 by any convention mean is a sprocket gear 40. A second shaft 42 is rotatably mounted between support wall 36 and 38 and, in like manner to shaft 34, shaft 42 drivingly supports rollers 32 and has a second sprocket gear 44 fixable mounted to the forward end thereof. The rollers 30 and 32 are mounted on their respective shaft 34 and 42 in a longitudinally staggered orientation. To accommodate a portion of roller 30 and 32 above the feed deck 26 surface, a plurality of slots 46 are located in the feed deck 26 vertically aligned respectively to the placement of roller 30 and 32.

Figure 6:
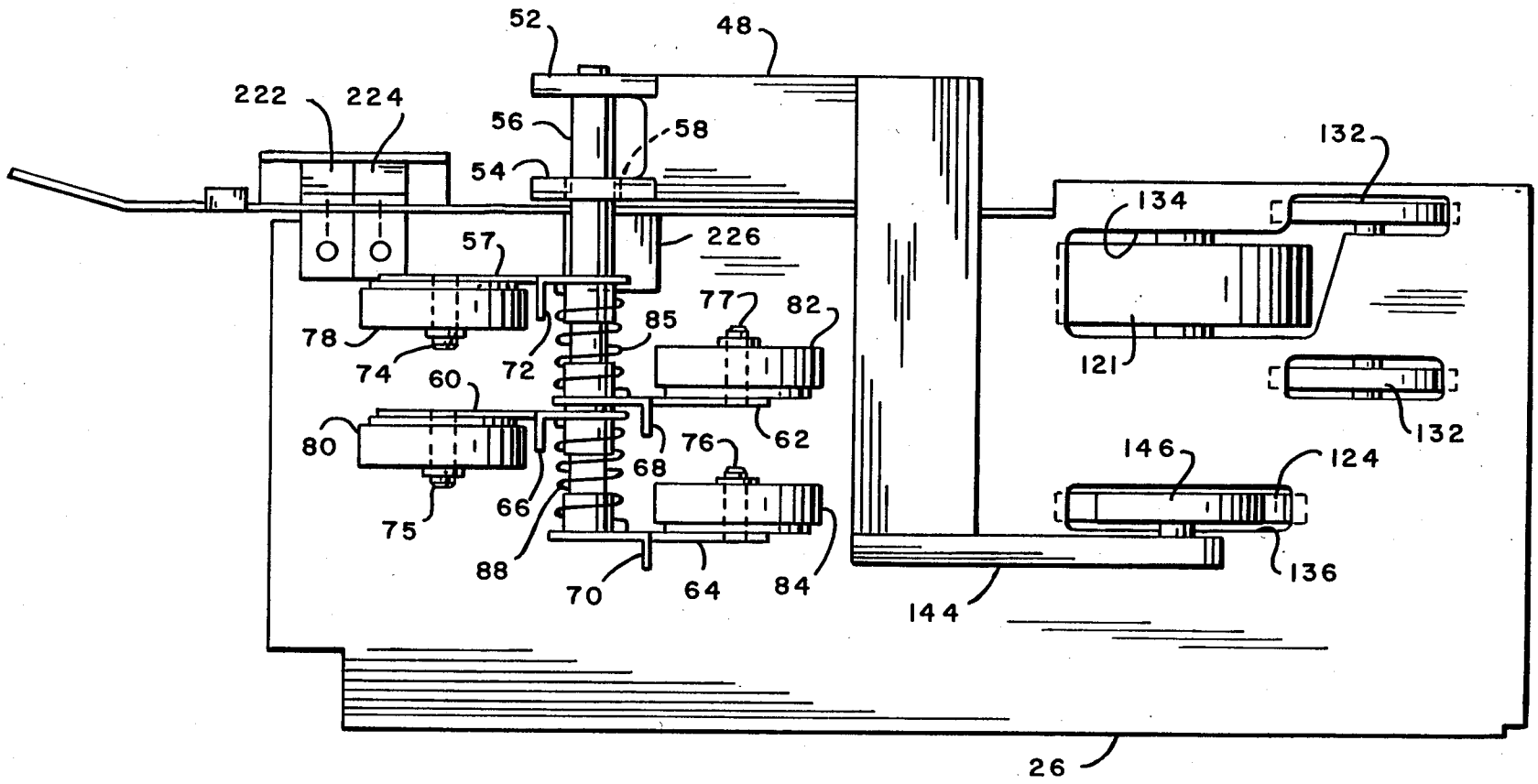
FIG. 6 is a sectional view of the transport assembly taken alone line 6—6.

Referring additionally to FIG. 6, the transport assembly 28 further includes a support strut 48 fixable mounted by any conventional means to the base plate 50 of the mailing machine. The support strut 48 has a generally vertical extension and is positioned laterally relative to the feed deck 26. Fixably mounted to a vertical portion of the support strut 48 in transversing space apart relationship is a plurality of flanges 52 and 54. One end of a shaft 56 is fixable mounted mounted by any conventional means to flange 52 and extends through an aligned aperture 58 in flange 54. The shaft 56 extends forwardly of the strut 48 above the feed deck 26 and has pivotally mounted thereon by any conventional means in fixed axial location a plurality of arms 57, 60, 62 and 64. The arms 57 and 60 are pivotally mounted on the shaft 56 at one end in spaced apart relationship and extend leftwardly therefrom. The arms 62 and 64 are pivotally mounted on the shaft 56 at one end in space apart relationship and extend rightwardly therefrom. The arms 57, 60, 62 and 64 are arranged such that the shaft mounting end of arms 60 and 62 are located endwise adjacent and extend in longitudinally opposite directions. The shaft mounting end of arms 57 and 64 are place in spaced apart relationship locating arms 60 and 62 therebetween and, in like manner, extend in opposite longitudinal direction. Further, shaft mounting ends of arms 60 and 62 include respective tabs 66 and 68 which form oppositely facing pinch surfaces. The shaft mounting end of arms 57 and 64 include respective tabs 70 and 72 which, in like manner, form pinch surfaces.

Arms 57 includes a stub shaft 74 extending forwardly therefrom. A roller 78 is rotatably mounted to the stub shaft 74 in vertical alignment to a respective roller 30. In like manner, arm 60 has formed thereto a stub shaft 75 rotatably supporting a roller 80 in vertical alignment to a respective roller 30. In similar manner, arm 62 includes a stub shaft 77 extending rearward therefrom. A roller 82 is rotatably mounted to stub shaft 77 in vertical alignment to a respective roller 32. In like manner to roller 82, a roller 84 is rotatably supported on a stub shaft 76 forming part of arm 64 in vertical alignment to respective roller 32.

A torsional coil spring 85 is located around a portion of shaft 56 between arms 57 and 62. The spring 86 ends are anchored at a point along the respective arms 57 and 62 by any conventional means such that the arms 57 and 62 are biased in a downward direction bring roller 78 and 82 in forced communication with a respective rollers 30 and 32. In like manner, a torsional coil spring 88 is located around a portion of shaft 56 between and anchored at the ends to respective arms 60 and 64 to bias arms 60 and 64 downwardly bring rollers 80 and 84 into forced communication with a respective roller 30 and 32. It is here noted that the longitudinal alignment of cooperating rollers is chosen to provide additional sealing force to a traversing envelope.

Figure 4:
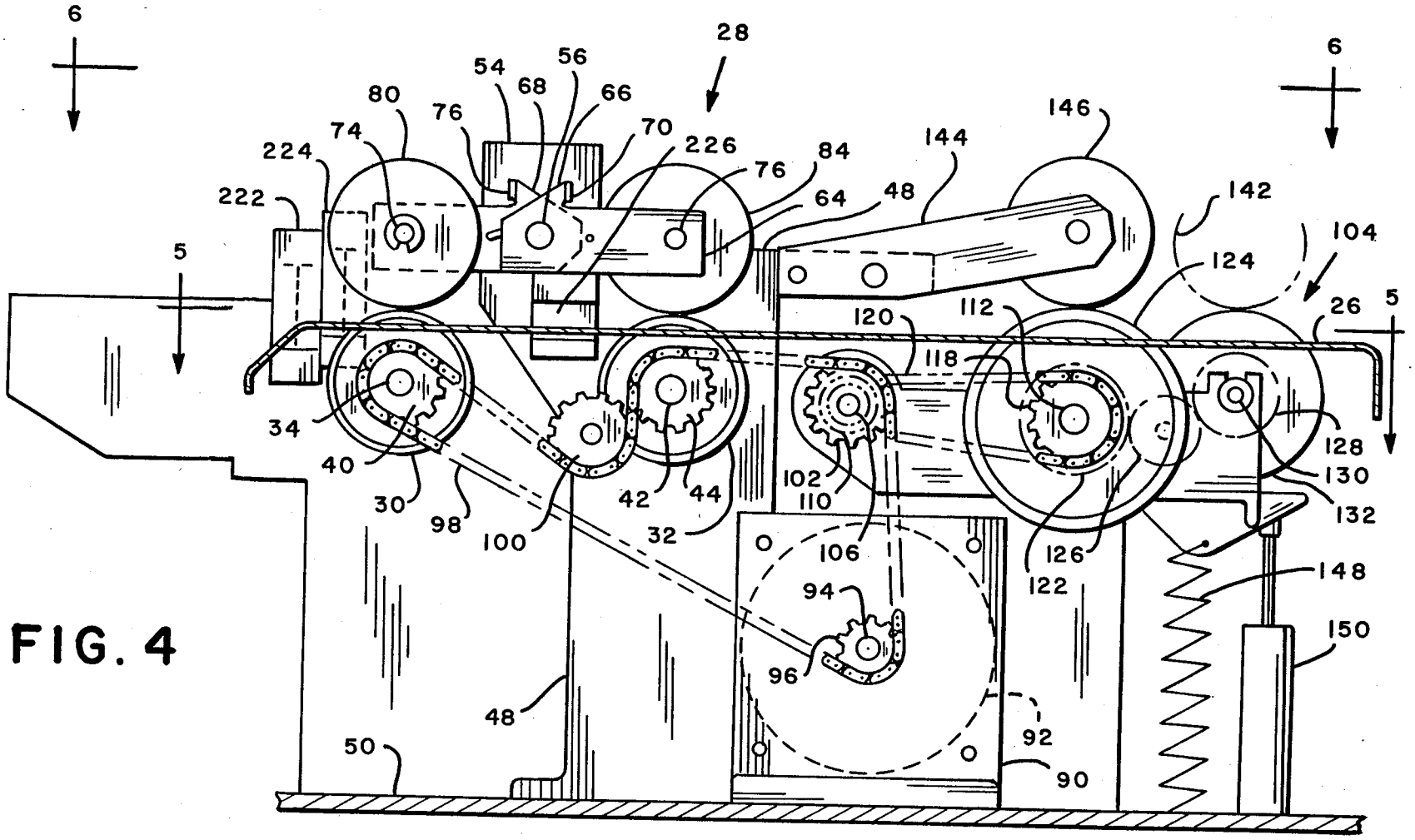
FIG. 4 is a side sectional elevational view of a mailing machine having a transport assembly in accordance with the present invention.

Referring to FIG. 4, a motor mounting plate 90 is fixably mounted to the base plate 50 of the mailing machine. In the preferred embodiment, a stepper motor 92 is fixably mounted by any conventional means to the motor mounting plate 90. The output shaft 94 of the stepper motor 92 has fixably mounted therearound a sprocket gear 96. An endless chain 98 provides driving communication between sprocket gear 96 and sprocket gears 36 and 44. The endless chain 98 also communicates with a tension idler sprocket gear 100, mounted to the mailing machine by any conventional means. The tension idler sprocket gear 100 is mounted in a conventional manner so as to provide constant chain tension. The chain 98 also communicates with an additional sprocket gear 102. The sprocket gear 102 is fixably mounted by any conventional means to one end of a shaft 104 which is rotatably supported by any conventional means between support wall 36 and 38.

The aforedescribed portion of the transport assembly 28 receives incoming envelopes seriately discharged from the inserter 14 and assumes control over the envelope 16 to preform velocity and pitch adjustment on the envelope as needed, in a manner to be described subsequently, prior to the arrival of the envelope at the print station, generally indicated as 104, of the mailing machine 10. The transport assembly 28 further include means to maintain control of the envelope during the time the envelope is traversing the print station 104 and the indicia is applied. For providing the additional control, the transport assembly further includes a bracket assembly 108 pivotally mounted by any conventional means around the shaft 104 in fixed axial location. Also pivotally mounted around the shaft 106 and fixably mounted axially to sprocket gear 102 by any conventional means is a sprocket gear 110 such that driven sprocket gear 102 drives sprocket gear 110.

A shaft 112 is pivotally mounted between the rightwardly extending bracket arms 114 and 116 of bracket 108 by any conventional means. Fixably mounted by any conventional means to one end of the shaft 112 is a sprocket 118. An endless chain 120 is placed around sprockets 110 and 118 such that driven sprocket 110 drives sprocket 118. Also fixably mounted to shaft 112 at points along its length, in outward order, are an impression roller 121, a gear 122 and a preposition roller 124. A second gear 126 is rotatably mounted to bracket arm 118 in constant mesh with gear 122 and with a gear 128 which is fixably mounted by any conventional means to a shaft 130. The shaft 130 is rotatably mounted between the rightward-most portion of bracket arms 114 and 116. Also fixably mounted to the shaft 130 are a plurality of rollers 132.

It is noted that the feed deck 26 of the mailing machine contains slots 134, 136 and 138. Slot 134 accommodates a portion of impression roller 121 and a respective roller 132 for protruding therethrough. In like manner, slot 136 accommodates preposition roller 124 and slot 138 accommodates a respective roller 132. It is also noted that a suitable postage meter 26 of generally conventional design, for example, a Pitney Bowes Postage Meter Model Series 5300, includes a print drum (not shown) located opposite the impression roller 121 and idle rollers 142 located opposite respective rollers 132. The mailing machine 10 further includes a bracket 144 mounted to a vertical portion of support strut 48. The bracket 144 rotatably supports by any conventional means a roller 146 in vertical peripheral communication with roller 124. Also included in the mailing machine is a compression spring 148 and damper 150, each having one end fixably mounted by any conventional means to the base 50 and the other end fixably mounted by conventional means to the bracket assembly 108. The pivotal mounting of the bracket 108 permits the bracket 108 to deflect downwardly in response to the thickness of a traversing envelope.

Figure 5:
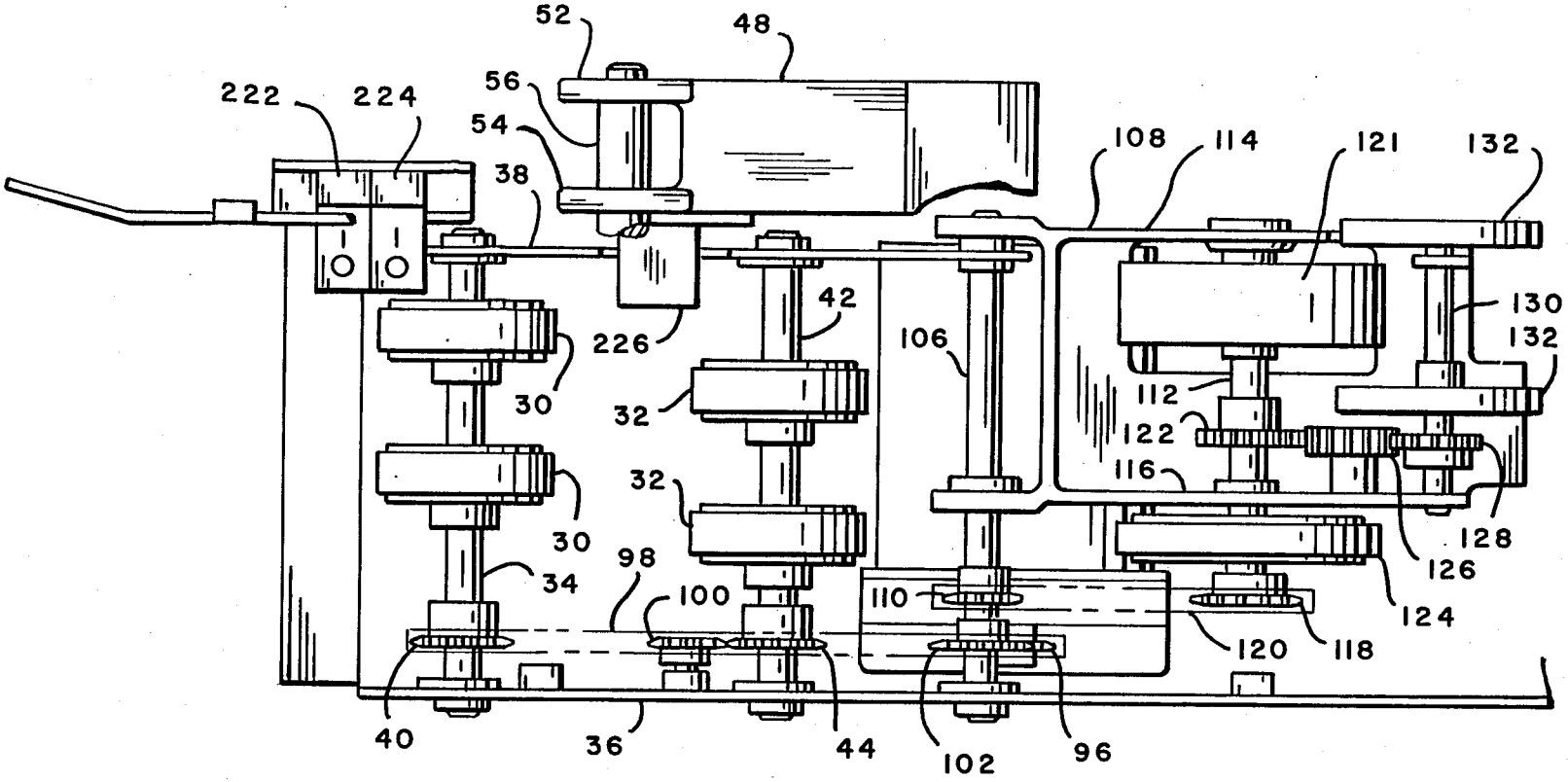
FIG. 5 is a sectional view of the transport assembly taken along line 5—5.
Figure 7:
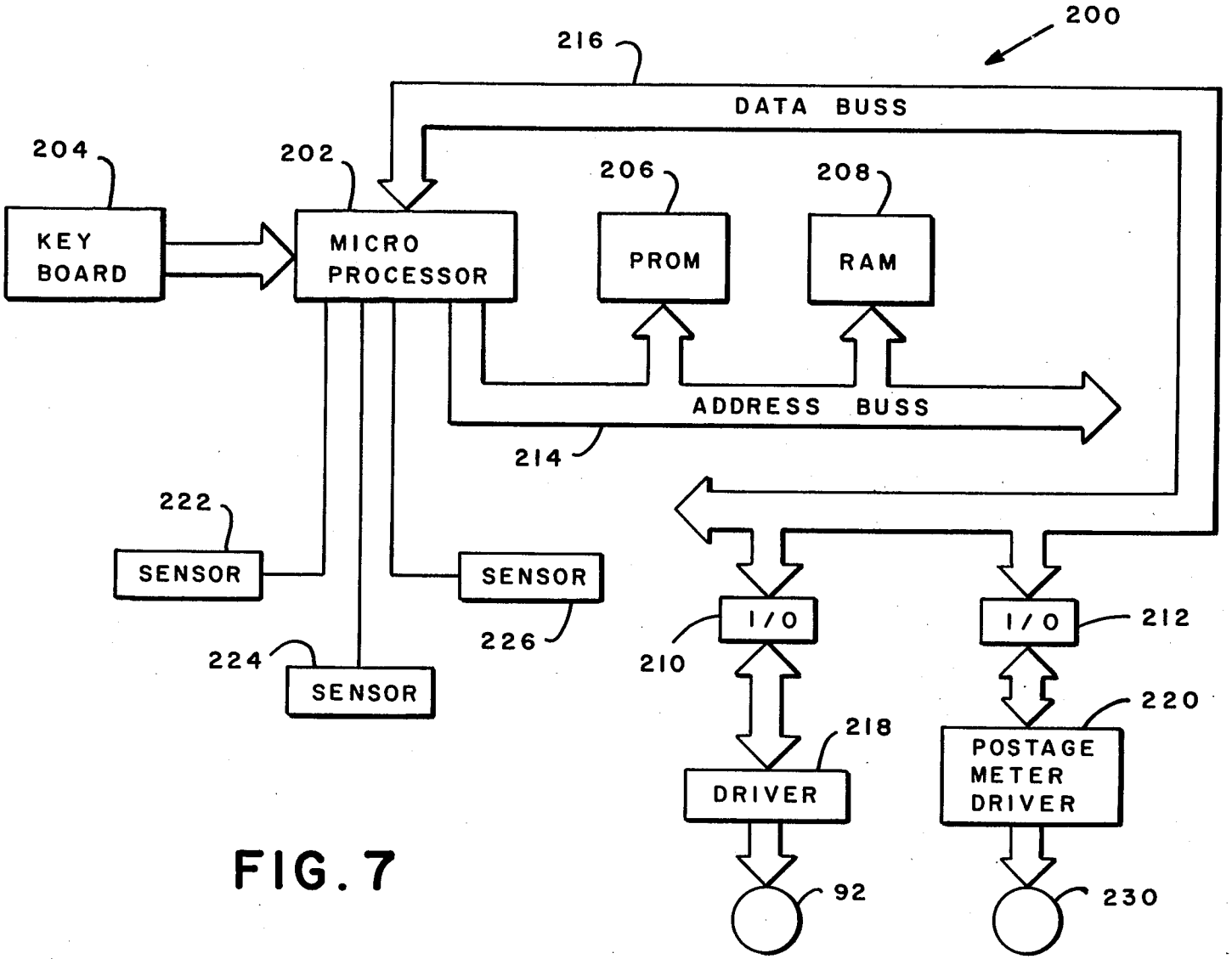
FIG. 7 is a schematic representation of a microcomputer for suitable controlling the transport assembly.

The stepper motor 92 is under the control of a microcomputer 200 schematically shown in FIG. 7 suitable mounted in a conventional manner within the mailing machine 10. The microcomputer 200 is of conventional architecture having a microprocessor 202, external keyboard input means 204 (not shown in FIG. 3), programmable read only memory (PROM) 206, random access memory (RAM) 208 and a plurality of input-output (I/O) unit 210 and 212. Internal communication is provided by means of a address and data bus 214 and 216, respectively. A plurality of driver circuits 218 and 220 are in communication with the microcomputer 200 in a conventional manner through respective I/O units 210 and 212. One of the drivers, for example, driver 218, controllably communicated with stepper motor 92. Also, in direct communication with the microprocessor 202 are a plurality of sensors 222, 224 and 226 which preferably are photodetection sensors. As best shown in FIGS. 4, 5 and 6, the sensors 222 and 224 are mounted to the mailing machine by any suitable means laterally adjacent one another and slightly leftward of rollers 30. The sensor 226 is mounted to the mailing machine longitudinally between rollers 30 and 32.

In operation, an envelope is ejected from the inserter to the mailing machine feed deck 26. Prior to the envelope coming under the control of the transport assembly 28, the leading portion of the envelope actuates sensor 222. Upon actuation of the sensor 222 by the leading portion of a traversing envelope, the microcomputer institutes a timing sequence in a conventional manner. When the leading portion of the envelope then encounters and actuates the sensor 224, the microcomputer ends the timing sequence. The microcomputer 200 is now able to calculate the linear velocity of the incoming envelope based upon the fixed distance between sensors 222 and 224. The microcomputer 200 then instructs the driver 218 to drive stepper motor 92 at an angular velocity corresponding to the linear velocity of the incoming envelope. The envelope 16 is then captured between driven lower rollers 30 and upper rollers 78 and 80.

The envelope 16 then proceeds to traversely actuate sensor 226. Upon actuation of sensor 226, the microcomputer 200 instructs the driver 218 to either decrease or increase the angular velocity of the stepper motor 92 to a preselected speed. It is here noted that the microcomputer 200 as aforedescribed causes the traversing envelope 16 to be delivered to the printing station 104 at a preselected linear velocity generally matching to the operating peripheral velocity of the postage meter print drum. That is, the preselected velocity is dependent on the operating characteristic of the printing method employed. Noting that the envelope is under the control of preposition roller 124 and roller 146, the rollers 132 and 142 of the transport assembly, subsequent to indicia printing by print drum, the microcomputer causes the transport assembly to resume the recorded incoming speed of the envelope 16.

Referring to FIGS. 3 and 7, one type of conventional postage meter 25, for example, the Pitney Bowes Model Series Model 5300, includes a print drum (not shown) which print drum is drivenly responsive to a gear 242 rotatably mounted in and driven by a stepper motor 230 located with the mailing machine. As an alternative of the present invention, the stepper motor 230 is also responsive to the microcomputer 200 via driver 220. The microcomputer 200 is programmed to calculate the relative time arrival of the envelope to the printing station 104 predicated upon the actuation of sensor 226. Stepper motor 230 is responsive to a postage meter driver 220 in communication with the microprocessor through I/O 212 in a conventional manner. The microcomputer is therefor able to drive the print cycle of the postage meter at a infinite variety of cycle speeds, within a given postage meter operation range, complimentary to the velocity of the envelope which is subject to the transport assembly speed. Therefore, when the incoming envelope velocity is less than the peripheral equivalent of the specified operating velocity of the print drum drive assembly, the stepper motor 230 is instructed by the microcomputer to drive the print drum assembly at a velocity generally equal to the envelope velocity.

Should the subsequent envelope 16 have a greater velocity than the previous envelope 15, but less than the specified velocity of the postage meter, the encounter of the subsequent envelope 15 with the sensors 222 and 224 will cause the microcomputer to increase the velocity of the transport system and print drum accordingly, in like manner as aforedescribed. Should the subsequent envelope 15 have a velocity greater than the specified velocity of the postage meter, the transport system and print drum respond to the microcomputer as aforedescribed in the preferred embodiment.

It should now be appreciated that the mailing machine transport system permits the mailing machine to marry with a variety of inserters which vary in operation speed. Further, the transport system promotes jam free operation in the mailing machine by compensating for variations in feed velocity and pitch distance of the inserter.

What is claimed is:

1. In a mailing machine having a feed deck and a postage meter mounted to said mailing machine at a location along said feed deck such that a portion of said postage meter is in spaced relation to said feed deck to define a printing station, feed means for delivering a plurality of mailpieces to said feed deck in a seriatim manner and within a given linear velocity range said postage meter having a print means for the printing of an indicia on each of said mailpieces as it traverses said print station, said mailing machine including a transport system comprising:

a. first means for capturing each of said mailpieces as it is received from said feed means and controllably transporting said mailpiece along said feed deck and maintaining control during indicia printing by said postage meter and thereafter ejecting said mailpiece from said mailing machine, said first means to including, movable means for receiving said mailpiece and establishing positive position control of said mailpiece substantially throughout the traversal path of said mailpiece along said mailing machine feed deck, drive means for driving said movable means, control means for controlling said drive means such that said drive means drives said movable means at an initial velocity generally equal to or greater than said velocity of said fed mailpiece, and subsequent to said movable means establishing control of said mailpiece and prior to indicia printing causing said drive means to adjust said velocity of said movable means to a predetermined velocity if said initial first velocity is greater than said predetermined velocity.

2. In a mailing machine having a feed deck and a postage meter mounted to said mailing machine at a location along said feed deck such that a portion of said postage meter is in spaced relation to said feed deck to define a printing station, feed means for delivering a plurality of mailpieces to said feed deck in a seriatim manner and within a given linear velocity range said postage meter having a print means for the printing of an indicia on each of said mailpieces as it traverses said print station, said mailing machine including a transport system comprising:

a. first means for capturing each of said mailpieces as it is received from said feed means and controllably transporting said mailpiece along said feed deck and maintaining control during indicia printing by said postage meter and thereafter ejecting said mailpiece from said mailing machine, said first means including, movable means for receiving said mailpiece and establishing positive position control of said mailpiece substantially throughout the traversal path of said mailpiece along said mailing machine feed deck drive means for driving said movable means control means for controlling said drive means such that said drive means drives said movable means at an initial velocity generally equal to or greater than said velocity of said fed mailpiece, and subsequent to said movable means establishing control of said mailpiece and prior to indicia printing causing said drive means to adjust said velocity of said movable means to a predetermined velocity if said initial first velocity is greater than said predetermined velocity, and subsequent to indicia printing on said mailpiece cause said drive means to adjust said velocity of movable means to said initial velocity.

3. In a mailing machine as claimed in claim 2 wherein said movable means comprises:

said mailing machine feed deck having a plurality of first slots formed therein upstream of said printing station, a plurality of first rollers rotatably mounted in said mailing machine such that a radial portion of said rollers extend through said first slots, a plurality of second rollers, first support means for mounting of said second rollers rotatably thereto such that said second rollers are in forced peripheral contact tangentially with a respective one of said first rollers and such that said second rollers are displaceable apart from said first respective first roller in response to the thickness of said traversing mailpiece, said mailing machine feed deck having a plurality of second slots formed therein downstream of said printing station, a plurality of third rollers, second mounting means for rotational mounting of said third rollers such that a portion of said third rollers extends radially through a respective one of said second slots and such that said third rollers may be deflected from a first position to a second position in response to the thickness of said traversing mailpiece, said postage meter having mounted thereto idle rollers in peripheral contact with a respective one of said third rollers.

4. In a mailing machine as claimed in claim 3 wherein said drive means comprises:

a stepper motor fixably mounted within said mailing machine and in electrically responsive communication with said control means, said stepper motor including a output shaft, transmission means in driven communication with said output shaft of said stepper motor for providing driving communication between said first and third rollers and said output shaft.

5. In a mailing machine as claimed in claim 1 or 4 wherein said control means comprises:

a microcomputer having a microprocessor in communication with a driver circuit sensing means in electrically informing communication with said microcomputer for sensing the position of said mailpiece just prior to said mailpiece being received by said movable means such that said microcomputer can determine the linear velocity of said traversing mailpiece, means for activating said postage meter print means such that said a single print cycle is effectuated coordinately with the velocity of the traversing mailpiece, said activation of said print cycle to commence upon the presentation of said mailpiece to a preselected location relative to said printing station.

6. In a mailing machine having a feed deck and a postage meter mounted to said mailing machine at a location along said feed deck such that a portion of said postage meter is in spaced relation to said feed deck to define a printing station, feed means for delivering a plurality of mailpieces to said feed deck in a seriatim manner and within a given linear velocity range said postage meter having a print means for the printing of an indicia on each of said mailpieces as it traverses said print station, said mailing machine including a transport system comprising:

said mailing machine feed deck having a plurality of first slots formed therein upstream of said printing station, a plurality of first rollers rotatably mounted in said mailing machine such that a radial portion of said rollers extend through said first slots, a plurality of second rollers, first support means for mounting of said second rollers rotatably thereto such that said second rollers are in forced peripheral contact tangentially with a respective one of said first rollers and such that said second rollers are displaceable apart from said first respective first roller in response to the thickness of said traversing mailpiece, said mailing machine feed deck having a plurality of second slots formed therein downstream of said printing station, a plurality of third rollers, second mounting means for rotational mounting of said third rollers such that a portion of said third rollers extends radially through a respective one of said second slots and such that said third rollers may be deflected from a first position to a second position in response to the thickness of said traversing mailpiece, said postage meter having mounted thereto idle rollers in periheral contact with a respective one of said third rollers, drive means for rotatably driving said first and third rollers cooperatively, control means for controlling said drive means such that said drive means drives said movable means at a initial velocity generally equal to or greater than said velocity of said fed mailpiece, and subsequent to said movable means establishing control of said mailpiece and prior to indicia printing causing said drive means to adjust said velocity of said movable means to a predetermined velocity if said initial first velocity is greater than said predetermined velocity, and subsequent to indicia printing on said mailpiece causing said drive means to adjust said velocity of a movable means to said initial velocity.

7. In a mailing machine as claimed in claim 6 wherein said drive means comprises:

a stepper motor fixably mounted within said mailing machine and in electrically responsive communication with said control means, said stepper motor including a output shaft, transmission means in driven communication with said output shaft of said stepper motor for providing driving communication between said first and third rollers and said output shaft.

8. In a mailing machine as claimed in claim 7 wherein said control means comprises:

a microcomputer having a microprocessor in communication with a driver circuit sensing means in electrically informing communication with said microcomputer for sensing the position of said mailpiece just prior to said mailpiece being received by said movable means such that said microcomputer can determine the linear velocity of said traversing mailpiece, means for activating said postage meter print means such that said a single print cycle is effectuated coordinately with the velocity of the traversing mailpiece, said activation of said print cycle to commence upon the presentation of said mailpiece to a preselected location relative to said printing station.

9. In a mailing machine having a housing, a portion of said housing forming a feed deck and a postage meter mounted to said mailing machine at a location along said feed deck such that a portion of said postage meter is in spaced relation to said feed deck to define a printing station, feed means for delivering a plurality of mailpieces to one end of said feed deck in a seriatim manner and within a given linear velocity range said postage meter having a print means for the printing of an indicia on each of said mailpieces as it seriately traverse said print station, said mailing machine including a transport system comprising:

said mailing machine feed deck having a plurality of first slots formed therein upstream of said printing station, a plurality of shafts rotatabkly mounted in said mailing machine housing below said feed deck, a plurality of first forward rollers fixably mounted centrally around a first one of said shafts in axially spaced apart relationship such that a radial portion of said first forward rollers extend through respective one of said first slots, a plurality of second forward rollers fixably mounted centrally around a second one of said shafts axially spaced apart relationship such that a radial portion of said second forward rollers extends through a respective one of said first slots, said first and second forward rollers being in transversely staggered longitudinal alignment, a plurality of second rollers, first support means for mounting of said second rollers rotatably thereto such that second rollers are in forced peripheral contact tangentially with a respective one of said first forward rollers and such that said second rollers are displaceable apart from a respective first and second forward roller in response to the thickness of said traversing mailpiece, said mailing machine feed deck having a plurality of second slots formed therein downstream of said printing station, a plurality of third rollers, second mounting means for rotational mounting of said third rollers such that a portion of said third rollers extends radially through a respective one of said second slots and such that said third rollers may be deflected from a first position to a second position in response to said traversing mailpiece, said postage meter having mounted thereto idle rollers in peripheral contact with a respective one of said third rollers, a stepper motor fixably mounted within said mailing machine housing, said stepper motor including a output shaft, transmission means in driven communication with said output shaft of said stepper motor for providing driving communication between said stepper motor and said first and second one of said shafts and said third rollers, control means for controlling said stepper motor such that said stepper motor drives said transmission means in a manner such that said first and second forward rollers receive an equivalent initial peripheral velocity generally equal to or greater than said velocity of said fed mailpiece, adjust said velocity of said first and second forward rollers generally upon reaching by said mailpiece of a predetermined velocity if said initial velocity is greater than said predetermined velocity or decreasing said velocity of said first and second forward rollers generally upon reaching by said mailpiece of a velocity by a predetermined amount if said initial velocity is less than said predetermined velocity and reset said predetermined velocity there equal to, and subsequent to indicia printing on said mailpiece cause said stepper motor to adjust said velocity of said third rollers to said initial velocity.

10. In a mailing machine as claimed in claim 9 wherein said second mounting means comprises:

a third one of said plurality of shafts being rotatably mounted in said mailing machine housing, said third shaft having a double sprocket, one of said sprockets in driven communication with said transmission means, a bracket rotatably mount to said third shaft and having parallel extending bracket arms in transverse spaced apart relationship, a fourth one of said plurality of shafts being rotatably mounted to said bracket arms, said fourth shaft having a second sprocket fixably mounted thereto at one end, a fourth roller fixably mounted centrally around said shaft, a impression roller rotatably mounted in fixed axially location opposite said printing means of said postage meter and a first gear, a fifth one of said shafts being rotatably mounted to said bracket arms downstream of said impression roller and having said third rollers fixably mounted thereto and having a second gear fixably mounted thereto in constant meshed communication with said first gear, said feed deck having further third slots formed therein aligned to said impression roller and said fourth roller such that a radial portion of said impression roller and said fourth roller extends therethrough, a fifth roller rotatably mounted to said first support means in fixed position radially opposite said fourth roller, second transmission means for drivingly communicating said double sprocket to said second sprocket, means for biasing said bracket in a first position providing dampened deflection to a variety of second positions.

11. In a mailing machine as claimed in claim 10 wherein said control means comprises:

a microcomputer having a microprocessor in communication with a driver circuit a first photodetection sensor, a second photodetection sensor, said first and second photodetection sensors being fixably mounted to said mailing machine upstream of said first and second forward rollers in fixed longitudinal location relative to each other such that a fed mailpiece traverses sequentially said first and second photodetection sensors prior to being received by said first forward rollers and said second rollers, a third photodetection sensor, fixably mounted to said mailing machine between said first and second forward rollers such that a said mailpiece traverses said third photodetection sensor subsequent to receipt by said first forward rollers and respective second rollers, said first, second and third photodetection sensor in informing communication with said microcomputer, whereby activation of said first and second photodetection sensors provides said microcomputer with sufficient information to determine the linear velocity of said mailpiece just prior to said mailpiece being received by said first forward rollers and said second rollers and activation of said third photodetection sensor provides sufficient information for position locating of said mailpiece by said microcomputer and flags said microcomputer to initiate velocity adjustment if necessary, means for activating said postage meter print means such that said a single print cycle is effectuated coordinately with the velocity of the traversing mailpiece, said activation of said print cycle to commence upon the presentation of said mailpiece to a preselected location relative to said printing station as determined by said microcomputer.

12. A transport system for adjusting the linear velocity of a mailpiece traversing a feed deck, said mailpiece having an initial velocity within a given linear velocity range, comprising:

a housing having formed thereon a feed deck, said housing having a plurality of first slots formed therein at a location therealong, a shaft rotatably mounted in said housing below said feed deck, a plurality of first rollers fixably mounted centrally around said shafts in axially spaced apart relationship such that a radial portion of said first rollers extend through respective one of said first slots, a plurality of second rollers, first support means for mounting of said second rollers rotatably thereto such that said second rollers are in forced peripheral contact tangentially with a respective one of said first rollers such that said second rollers are displaceable apart from a respective first roller in response to a traversing mailpiece, a stepper motor fixably mounted within said housing, said stepper motor including a output shaft, transmission means in driven communication with said output shaft of said stepper motor for providing driving communication to said shafts, control means for controlling said stepper motor such that said stepper motor drives said transmission means in a manner such that said first rollers receive an equivalent initial peripheral velocity generally equal to or greater than said velocity of said fed mailpiece, adjust said velocity of said first rollers generally upon said mailpiece reaching a predetermined velocity if said initial first velocity is greater than said predetermined velocity.

13. A transport system as claimed in claim 12 wherein said control means comprises:

a microcomputer having a microprocessor in communication with a driver circuit, a first photodetection sensor, a second photodetection sensor, said first and second photodetection sensors being fixably mounted to said mailing machine upstream of said first and second rollers in fixed longitudinal location relative to each other such that a fed mailpiece traverses sequentially said first and second photodetection sensors prior to being received by said first rollers and said second rollers, a third photodetection sensor, fixably mounted to said feed deck between said first and second rollers such that a said mailpiece traverses said third photodetection sensor subsequent to recite by said first rollers and respective second rollers, said first, second and third photodetection sensors are in informing communication with said microcomputer, whereby activation of said first and second photodetection sensors provides said microcomputer with sufficient information to determine the linear velocity of said mailpiece just prior to said mailpiece being received by said first rollers and said second rollers and activation of said third photodetection sensor provides sufficient information for position locating said mailpiece by said microcomputer and flags the microcomputer to initiated velocity change if necessary.

* * * * *